US010976682B2

(12) United States Patent
Abe et al.

(10) Patent No.: US 10,976,682 B2
(45) Date of Patent: Apr. 13, 2021

(54) METHOD FOR CONTROLLING ELECTROPHOTOGRAPHIC APPARATUS

(71) Applicant: CANON KABUSHIKI KAISHA, Tokyo (JP)

(72) Inventors: Yukihiro Abe, Kashiwa (JP); Motoya Yamada, Matsudo (JP); Toshiyasu Shirasuna, Moriya (JP); Hironori Owaki, Kashiwa (JP); Jun Ohira, Moriya (JP); Yuu Nishimura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/801,057

(22) Filed: Feb. 25, 2020

(65) Prior Publication Data

US 2020/0278620 A1 Sep. 3, 2020

(30) Foreign Application Priority Data

Feb. 28, 2019 (JP) ..... JP2019-036834

(51) Int. Cl.
*G03G 15/04* (2006.01)
*G03G 15/00* (2006.01)

(52) U.S. Cl.
CPC ... *G03G 15/04027* (2013.01); *G03G 15/5041* (2013.01); *G03G 15/75* (2013.01); *G03G 15/751* (2013.01); *G03G 15/752* (2013.01); *G03G 2215/00063* (2013.01)

(58) Field of Classification Search
CPC ..... G03G 15/04027; G03G 15/5041; G03G 15/75; G03G 15/751; G03G 15/752; G03G 2215/00063; G03G 15/0115; G03G 2215/00042; G03G 15/5058
See application file for complete search history.

(56) References Cited

U.S. PATENT DOCUMENTS

2015/0253713 A1 9/2015 Osada et al.

FOREIGN PATENT DOCUMENTS

| | | | |
|---|---|---|---|
| EP | 1308792 | A2 | 5/2003 |
| JP | 3030975 | B2 | 4/2000 |
| JP | 2008310311 | A | 12/2008 |
| JP | 2010122249 | A | 6/2010 |
| JP | 2012083588 | A | 4/2012 |
| JP | 2015155963 | A | 8/2015 |
| JP | 2017187795 | A | 10/2017 |

OTHER PUBLICATIONS

Machine trnaslation of JP-2012083588 A (Year: 2012).*

* cited by examiner

*Primary Examiner* — G. M. A Hyder
(74) *Attorney, Agent, or Firm* — Canon U.S.A., Inc. IP Division

(57) ABSTRACT

There is provided a method for controlling an electrophotographic apparatus including forming a first measurement image by performing first halftone processing on image data, forming a second measurement image by performing second halftone processing different from the first halftone processing on the image data, measuring densities of the first measurement image and the second measurement image, calculating a density difference between each of densities of the measurement images, determining whether the density difference satisfies a predetermined reference value, and applying a surface treatment on an electrophotographic photosensitive member if the density difference does not satisfy the reference value, during a non-image formation period.

11 Claims, 4 Drawing Sheets

METHOD FOR CONTROLLING ELECTROPHOTOGRAPHIC APPARATUS

BACKGROUND

Field of the Disclosure

The present disclosure relates to a method for controlling an electrophotographic apparatus that detects a surface state of an electrophotographic photosensitive member and applies a surface treatment on the electrophotographic photosensitive member as necessary.

Description of the Related Art

In recent years, electrophotographic apparatuses have been starting to be used even in the printing field, as a writing resolution of a digital exposure has been increasing to 1200 dots per inch (dpi) to 2400 dpi. When being used in the printing field, the electrophotographic apparatuses are required to satisfy a further high level of printing quality compared to a printing quality required for the conventional electrophotographic method because a print product is treated as a commercial product.

One parameter that affects the printed image quality is a screen ruling. The screen ruling is defined based on the number of halftone dots contained in a width of one inch, and an increase in the screen ruling makes the halftone dots less visible and therefore allows the halftone to be further smoothly expressed, thus being said to be advantageous for improving the image quality.

The digital electrophotographic method forms a latent image on a surface of an electrophotographic photosensitive member due to a charge density distribution by evenly charging the electrophotographic photosensitive member and carrying out an exposure corresponding to image data to cancel electrification charges on the exposed portion. The electrophotographic photosensitive member should keep surface electric resistance (hereinafter also referred to as "surface resistance") thereon at a certain level or higher to hold the thus-formed latent image. The surface resistance on the electrophotographic photosensitive member is affected by a property of the surface of the electrophotographic photosensitive member itself and a substance attached to the surface of the electrophotographic photosensitive member. Regardless of which serves as a cause, a reduction in the surface resistance on the electrophotographic photosensitive member unintentionally equalizes the latent image formed by the charge density distribution in a planar direction, thereby undesirably leading to deterioration of the latent image and thus degradation of the image quality. Such deterioration of the latent image more likely occurs, as a spatial frequency of the latent image increases. In other words, as a higher screen ruling is set in a system with the aim of improving the image quality, this system undesirably becomes more prone to the deterioration of the latent image.

As a technique for controlling the resolution, Japanese Patent No. 3030975 discusses an image quality control apparatus having a reference patch group including at least one reference density patch having an even density and at least one reference resolution patch formed by a high density portion and a low density portion, which are placed on a document platen.

Further, as a surface treatment of the electrophotographic photosensitive member, Japanese Patent Application Laid-Open No. 2010-122249 discusses a technique that temporarily increases, for example, a voltage to apply to the surface of the electrophotographic photosensitive member to a higher voltage during a non-image formation period than during an image formation period, thereby suddenly raising a surface frictional coefficient μ and thus achieving an abrasive-rich cleaning roller. This technique is designed to efficiently remove a corona product and moisture attached on the surface of the photosensitive member with a required minimum amount of toner by polishing the surface of the photosensitive member using abrasive-rich toner.

The digital electrophotographic apparatuses involve such an issue that the change in the surface state of the electrophotographic photosensitive member causes a reduction in resolving power of the electrophotographic photosensitive member, thereby undesirably leading to the degradation of the printing quality.

SUMMARY

According to an aspect of the present innovation, the present disclosure provides a method for controlling an electrophotographic apparatus including a charging unit configured to evenly charge an electrophotographic photosensitive member, an exposure unit configured to form a latent image on the charged electrophotographic photosensitive member, a development unit configured to develop the latent image formed on the electrophotographic photosensitive member with toner, and a measurement unit configured to measure a density of the developed image. The method for controlling the electrophotographic apparatus includes storing two types of test image data acquired by performing first halftone processing and second halftone processing on predetermined halftone data into a storage unit of the electrophotographic apparatus in advance, and, during a non-image formation period, forming two types of test images from the two types of test image data, measuring densities of the two types of test images, calculating a density difference between the two types of test images, determining whether the density difference is equal to or smaller than a predetermined reference value or exceeds the predetermined reference value, and applying a surface treatment on the electrophotographic photosensitive member if the density difference exceeds the predetermined reference value.

Further features of the present disclosure will become apparent from the following description of exemplary embodiments with reference to the attached drawings.

DESCRIPTION OF THE EMBODIMENTS

The present disclosure is directed to preventing a reduction in resolving power of an electrophotographic photosensitive member and thus preventing degradation of an image quality by evaluating the resolving power of the electrophotographic photosensitive member and applying a surface treatment on the electrophotographic photosensitive member as necessary during a non-image formation period.

The non-image formation period refers to when an electrophotographic apparatus is started up or returns from a sleep state, and refers to when a user does not print a normal image on a paper medium or the like using the electrophotographic apparatus. A control method according to an exemplary embodiment of the present disclosure is configured to perform the following processes after charging the electrophotographic photosensitive member and writing in a plurality of patches as test image patterns for evaluating the resolving power to form latent images on the electrophotographic photosensitive member using an exposure device during the non-image formation period. A plurality of test toner images is formed by developing the plurality of formed latent images with toner at a developing device. Densities of the formed test toner images are measured on any of the electrophotographic photosensitive member, a transfer member, and a recording medium, and the resolving power of the electrophotographic photosensitive member is evaluated based on a relationship between a measured density and an area ratio of the image data written when the latent images are formed.

[Method for Controlling Electrophotographic Apparatus According to Present Exemplary Embodiment]

Figure 1A:
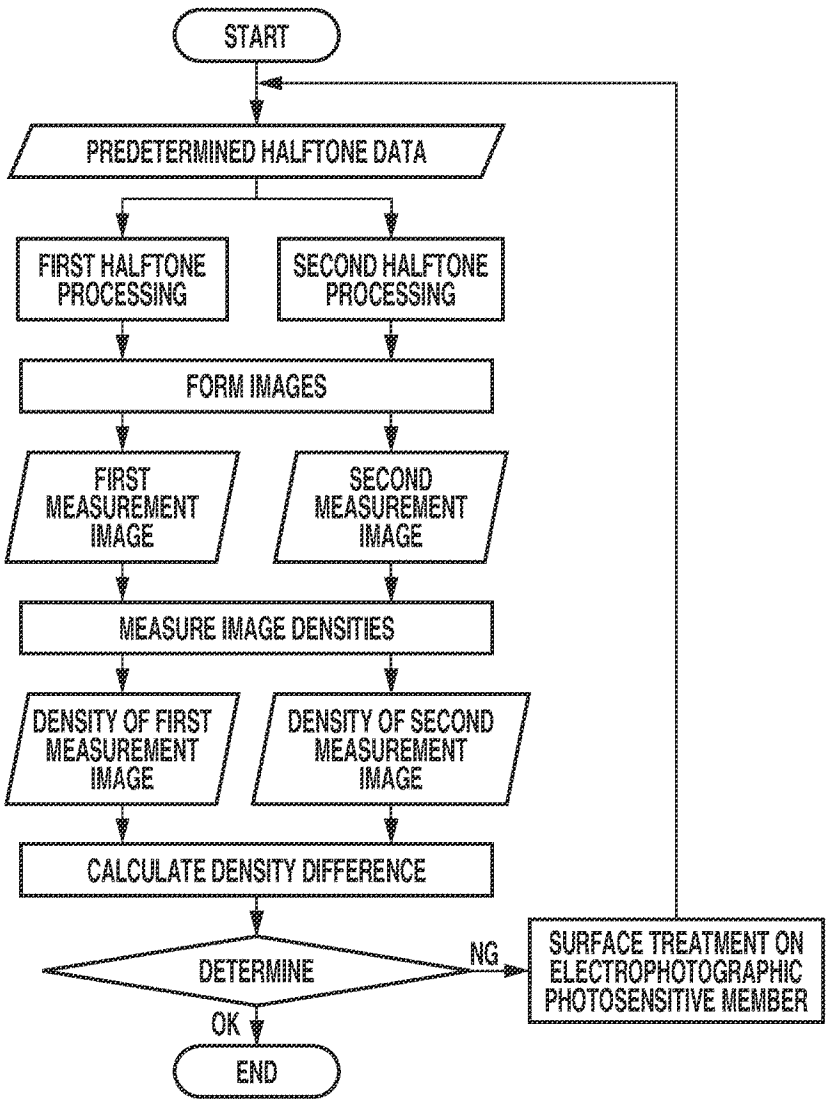
FIGS. 1A and 1B are flowcharts each illustrating a method for controlling an electrophotographic apparatus according to an exemplary embodiment of the present disclosure.
Figure 1B:
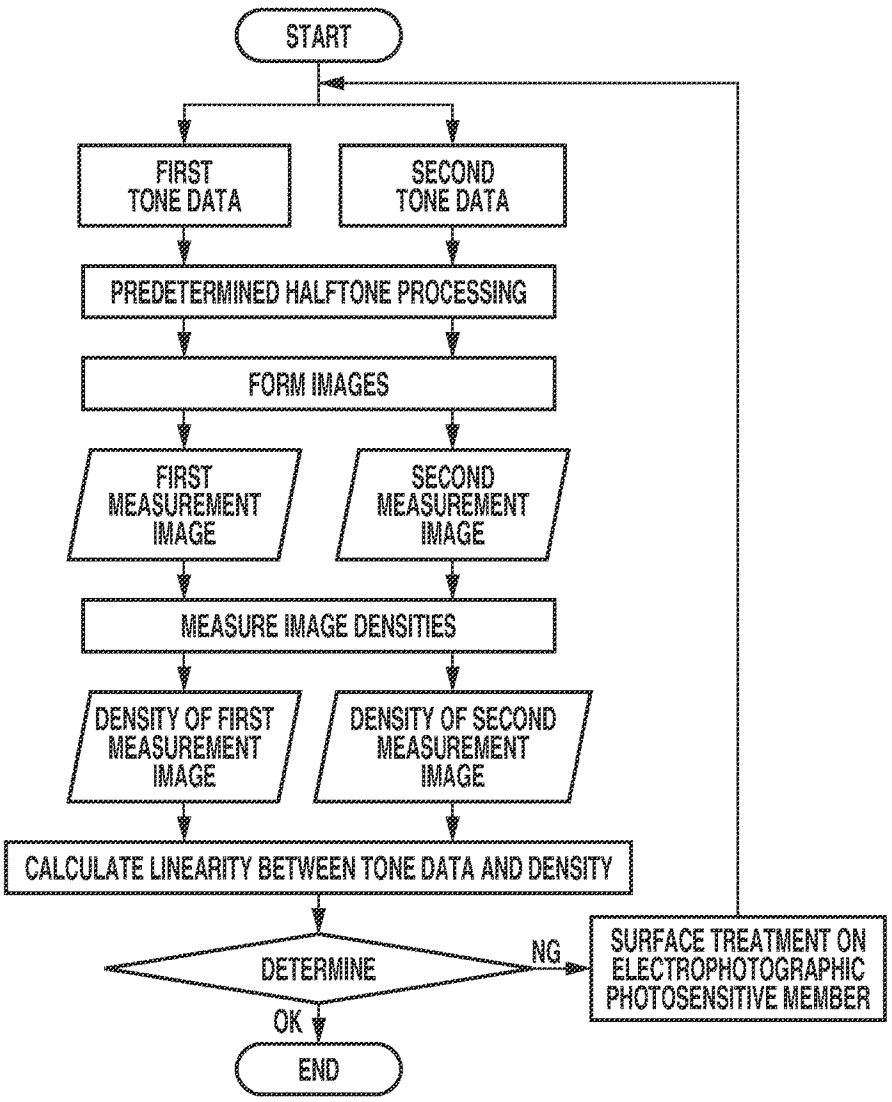

FIGS. 1A and 1B are flowcharts each illustrating a method for controlling an electrophotographic apparatus according to the present exemplary embodiment.

FIG. 1A illustrates a first mode of the method for controlling the electrophotographic apparatus according to the present exemplary embodiment. In the flowchart illustrated in FIG. 1A, the first mode forms two types of test images by performing two types of halftone processing, i.e., first halftone processing and second halftone processing on image data having a predetermined image density. The first mode may store two types of test image data formed by performing the two types of halftone processing on the image data having the predetermined image density in advance in a storage unit of the electrophotographic apparatus, and use these pieces of image data.

The two types of halftone processing mean expressing the same tone by image patterns different from each other. More specifically, images are formed from the image data having the predetermined image density in patterns at different spatial frequencies, by performing an error diffusion method or dither processing procedures based on different screen rulings on the image data having the predetermined image density. Two test images are formed from the above-described two types of test image data and densities of the thus-formed two types of images are measured during the non-image formation period. In an electrophotographic process, a latent image is formed as a charge density distribution on the surface of the electrophotographic photosensitive member by charging and exposure. When surface resistance reduces on the electrophotographic photosensitive member, the charge density distribution formed on the surface tends to change so as to become even, and may have a partial loss of charges in an image portion expressing the density, thereby making an output of a desired density difficult. When the latent image having a high spatial frequency is formed, this phenomenon is supposed to be easily affected thereby. In other words, performing the different types of halftone processing causes a density difference to be generated due to the different types of halftone processing, thereby allowing the surface state of the electrophotographic photosensitive member to be detected.

More specifically, the image densities of the two types of measurement images are measured by a measuring unit that measures a density of an image. The first mode calculates the density difference between the two types of measurement images, determines whether the above-described density difference is equal to or smaller than a predetermined reference value or exceeds the predetermined reference value, and applies the surface treatment on the above-described electrophotographic photosensitive member if the above-described density difference exceeds the above-described predetermined reference value.

The image density of the image data having an image density to be used is desirably lower than 50%. The image data having an image density lower than 50% results in generation of an isolated dot or a line pattern in the image pattern formed by performing the halftone processing on such image data and thus facilitates generation of the density difference according to the difference in the halftone processing, thereby being further desirable.

The two types of halftone processing are employed in the flowchart illustrated in FIG. 1A, but the necessity of the surface treatment of the electrophotographic photosensitive member may be determined by employing three or more types of halftone processing.

On the other hand, FIG. 1B illustrates a second mode of the method for controlling the electrophotographic apparatus according to the present exemplary embodiment. In the flowchart illustrated in FIG. 1B, the second mode forms images by performing the same halftone processing on image data having a first image density and image data having a second image density. The first image density and the second image density are different from each other. More specifically, the second mode forms a plurality of measurement images by performing predetermined halftone processing on pieces of image data having a plurality of image densities, measures densities of the plurality of measurement images, and makes the evaluation by comparing the densities of the plurality of measurement images with a predetermined reference value during the non-image formation period. More specifically, the second mode calculates and evaluates linearity of the above-described plurality of densities with respect to the pieces of image data having the above-described image densities. The second mode is designed to determine whether the linearity is lower than a predetermined reference value or equal to or higher than the predetermined reference value, and apply the surface treatment on the above-described electrophotographic photosensitive member if the linearity (linearity acquired using the method of least squares; the reference value is, for example, a value of R at this time) is lower than the above-described reference value. The second mode forms the measurement images from the two formed pieces of image data, and measures densities at three points, i.e., the two measurement images and an origin corresponding to a density of zero. The second mode calculates the linearity of the densities of the measurement images with respect to the input images having the two image densities and the origin corresponding to the density of zero.

In the electrophotographic process, the latent image is formed as the charge density distribution on the surface of the electrophotographic photosensitive member by the charging and the exposure. When the surface resistance reduces on the electrophotographic photosensitive member, the charge density distribution formed within the plane tends to change so as to become even, and may have a partial loss of charges in the image portion expressing the density, thereby making the output of the desired density difficult. When the latent image having an extremely small area is formed, this phenomenon is easily affected thereby. More specifically, the linearity with respect to the pieces of image data having the different image densities changes, and therefore allows the surface state of the electrophotographic photosensitive member to be detected. The second mode determines the surface state of the electrophotographic photosensitive member from the calculated linearity, and applies the surface treatment on the electrophotographic photosensitive member if the linearity fails to satisfy the reference value.

It is further desirable in light of the detection of the surface state on the electrophotographic photosensitive member to use halftone processing corresponding to a higher spatial frequency than halftone processing that the electrophotographic apparatus uses during the normal image formation period as the halftone processing performed in the flowchart illustrated in FIG. 1B.

Further, the image densities of the pieces of image data having the two image densities to be used are desirably lower than 50%. The halftone data having the image density lower than 50% results in generation of an isolated dot or a line pattern in the image pattern formed by preforming the halftone processing thereon and thus further easily affects the linearity of the density with respect to the image data having the image density, thereby being further desirable.

The flowchart illustrated in FIG. 1B indicates the control method when the two pieces of image data having the image densities are used, but the present exemplary embodiment may be configured to calculate the linearity using pieces of image data having three or more image densities.

[Image Patterns for Evaluating Resolving Power]

The image patterns for evaluating the resolving power of the electrophotographic photosensitive member will be described.

The resolving power of the electrophotographic photosensitive member is determined based on whether a latent image faithful to written data can be formed or maintained. The present exemplary embodiment evaluates the capability of maintaining the latent image formed on the electrophotographic photosensitive member.

As the spatial frequency of the latent image increases, the resolving power is more easily affected thereby as described above. Therefore, the image data for evaluating the resolution can be evaluated based on densities of a group of a plurality of image patterns formed by performing different halftone processing procedures on predetermined tone data (having the same density). Alternatively, the resolving power can be evaluated based on densities of a group of a plurality of image patterns formed by performing predetermined halftone processing on pieces of tone data having different densities.

The different halftone processing procedures refer to a combination of dither processing procedures corresponding to different screen rulings or a combination of error diffusion processing and dither processing.

Figure 2A:
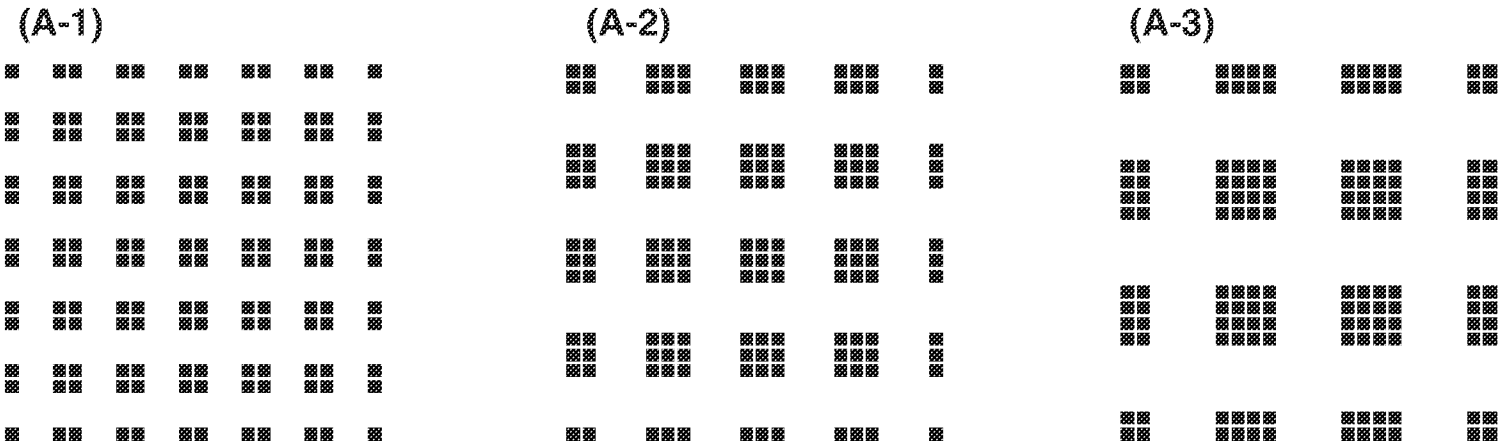
FIGS. 2A and 2B illustrate image data patterns for evaluating resolving power of an electrophotographic photosensitive member, according to an exemplary embodiment of the present disclosure.
Figure 2B:
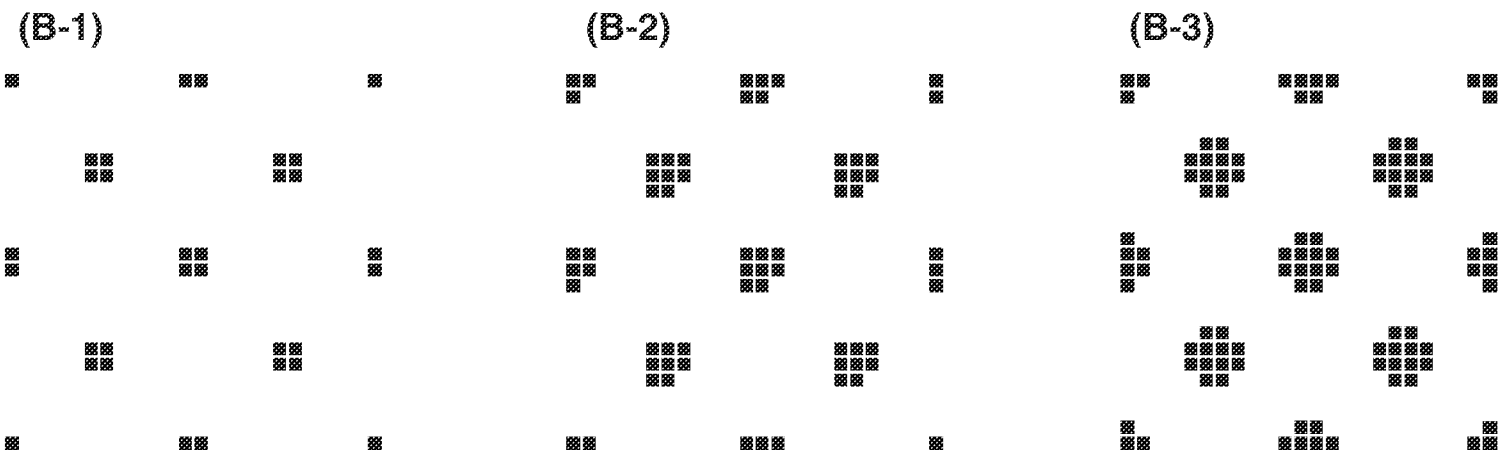

FIGS. 2A and 2B illustrate examples of the image patterns for evaluating the resolving power. The image patterns illustrated in FIGS. 2A and 2B indicate image patterns at a writing resolution of 2400 dots per inch (dpi). The image pattern group illustrated in FIG. 2A is the group of the image patterns formed by performing the different halftone processing procedures on the predetermined tone data. FIG. 2A illustrates a group of image patterns (A-1) to (A-3) acquired by performing dither processing procedures corresponding to different screen rulings on image data having an image density of 25%. The screen rulings of (A-1), (A-2), and (A-3) are 600 line per inch (lpi), 400 lpi, and 300 lpi, respectively.

On the other hand, the image pattern group illustrated in FIG. 2B is the group of the plurality of image patterns formed by performing the predetermined halftone processing on the different pieces of tone data. The halftone processing of the image patterns (B-1) to (B-3) illustrated in FIG. 2B is dither processing corresponding to a screen ruling of 283 lpi, and image densities of (B-1), (B-2), and (B-3) are 5.6%, 11.1%, and 16.7%, respectively.

A screen having the highest screen ruling used in the electrophotographic method inevitably varies depending on the machine type, but is often around 200 lpi in most cases. It is considered that this screen ruling is selected because the screen ruling that makes halftone dots unnoticeable in terms of human visual characteristics is around 200 lpi. On the other hand, as the screen ruling increases, the print result is more easily affected by the character resolution of the electrophotographic photosensitive member as described above. To evaluate the resolution of the electrophotographic photosensitive member, it is desirable to evaluate the resolution using a patch pattern containing a screen ruling corresponding to a higher resolution than a resolution at the highest screen ruling among screen rulings used in this electrophotographic apparatus as the screen ruling for use in the evaluation of the resolution. Therefore, the image data illustrated in FIGS. 2A and 2B is optimum image patterns when the electrophotographic apparatus to which the present exemplary embodiment is applied uses a screen ruling of around 200 lpi during the image formation period.

[Density Detection Sensor]

A density detection sensor that measures the densities of the test images (the toner images) formed from the image patterns for evaluating the resolving power will be described.

An optical sensor including a pair of a light emission element and a light reception element can be suitably used as the density detection sensor. Light emitted from the light emission element is reflected by a surface of the formed test image, and reflected light therefrom is received by the light reception element. The density can be calculated from a light reception signal by tabling a relationship between the light reception signal and the density in advance. A location at which the density of the test image is measured may be a position on the electrophotographic photosensitive member, or may be a position on the intermediate transfer member or a position on the recording medium. However, measuring the density on the electrophotographic photosensitive member is a further desirable method because leading to an evaluation of the capability of the resolving power of the electrophotographic photosensitive member itself without being affected by a transfer process and processes subsequent thereto.

[Method for Determining Resolving Power of Electrophotographic Photosensitive Member]

In the following description, a method for determining the resolving power of the electrophotographic photosensitive member using the above-described image patterns for evaluating the resolving power will be described.

First, the determination method when the image data group illustrated in FIG. 2A is used will be described. The determination method is preceded by measuring the relationship of the density with the halftone processing, determining the reference value of the density difference between the individual halftone processing procedures, and storing this reference value in the storage unit of the electrophotographic apparatus in advance, with the electrophotographic photosensitive member keeping the resolving power thereof in an excellent state. Because the area coverage modulation is the same among the image patterns (A-1) to (A-3), approximately similar densities are acquired as the measured densities with the electrophotographic photosensitive member keeping the resolving power thereof in the excellent state. However, when the resolving power of the electrophotographic photosensitive member reduces, the image data (A-1) having a high spatial frequency is first affected thereby and starts to output an unstable density, causing it to appear as a density difference from the image patterns (A-2) and (A-3). Comparing the measured density difference with the reference value allows the resolving power to be determined. FIG. 2A is assumed to use the three types of halftone processing, but the resolving power can be determined as long as at least two types of halftone processing are available.

Next, the determination method when the image data group illustrated in FIG. 2B is used will be described. The determination method is preceded by acquiring the relationship between the area coverage modulation and the density and storing the reference value regarding the linearity in advance, with the electrophotographic photosensitive member keeping the resolving power thereof in the excellent state. The relationship of the density with the area coverage modulation exhibits higher linearity with the electrophotographic photosensitive member keeping the resolving power thereof in the excellent state. However, when the resolving power of the electrophotographic photosensitive member reduces, the image data (B-1) corresponding to low area coverage modulation is first affected thereby and starts to output an unstable density, reducing the linearity of the density with respect to the area coverage modulation. Comparing the calculated linearity with the reference value allows the resolving power to be determined. FIG. 2B is assumed to use the three types of halftone processing, but the resolving power can also be determined by using two types of halftone processing and referring to three points including the zero point.

[Surface Treatment of Electrophotographic Photosensitive Member]

In the following description, the surface treatment for recovering the resolving power of the electrophotographic photosensitive member will be described.

As described above, the resolving power of the electrophotographic photosensitive member is susceptible to the influence of the surface resistance on the electrophotographic photosensitive member. The surface resistance is affected by a material property of the surface of the electrophotographic photosensitive member or an attached substance on the surface of the electrophotographic photosensitive member. Therefore, the surface treatment of the electrophotographic photosensitive member according to the present exemplary embodiment is a treatment for removing the attached substance or a treatment for modifying the altered material property of the surface of the electrophotographic photosensitive member, such as a treatment of oxidizing the surface.

First, examples of the method for removing the attached substance on the surface of the electrophotographic photosensitive member include a method that polishes the surface of the electrophotographic photosensitive member, such as a method discussed in the above-described patent literature, Japanese Patent Application Laid-Open No. 2010-122249. For example, in a case of a electrophotographic photosensitive member including a surface layer made of amorphous silicon carbide, it is known that the electrophotographic photosensitive member is subjected to formation of a hydroxyl group on an outermost surface and then an increase in hydrophilicity by, for example, being charged, and is thus affected by moisture under a high-humidity environment. This means that polishing the surface of the electrophotographic photosensitive member is effective to remove the attached substance on the outermost surface of the electrophotographic photosensitive member.

On the other hand, the control of the material property of the surface of the electrophotographic photosensitive member will be described referring to, as an example thereof, an electrophotographic photosensitive member in which the surface layer thereof is made of hydrogenated amorphous carbon containing less silicon elements to reduce the hydrophilicity of the surface layer and the surface resistance is controlled by applying the oxidation treatment on the outermost surface. Hydrogenated amorphous carbon has such a tendency that the $sp^2$ bond ratio increases and resistance reduces when a hydrogen amount reduces and a density of carbon atoms increases. Therefore, oxidizing the outermost surface made of hydrogenated amorphous carbon causes oxygen atoms to be bonded thereto, thereby being able to reduce the $sp^2$ bond ratio and enhance the surface resistance. However, the oxygen atoms bonded to the thus-modified outermost surface region are undesirably desorbed by being changed into $CO_2$ or CO in the long run, which may undesirably lead to an increase in the $sp^2$ bond ratio again and a reduction in the surface resistance, thereby undesirably resulting in a reduction in the surface resistance of the electrophotographic photosensitive member. Therefore, the resolving power can be recovered by applying the oxidation treatment on the surface of the electrophotographic photosensitive member in the electrophotographic apparatus when the resolving power of the electrophotographic photosensitive member reduces. More specifically, the outermost surface of the electrophotographic photosensitive member can be anodically oxidized by providing negative charges to the surface of the electrophotographic photosensitive member. In a case of a system that negatively charges the electrophotographic photosensitive member, this treatment can be realized just by carrying out an idle rotation, which repeats charges and discharges of the electrophotographic photosensitive member. On the other hand, in a case of a system that positively charges the electrophotographic photosensitive member, the above-described treatment can be realized by supplying negative charges within a range that does not exceed voltage resistance of the electrophotographic photosensitive member and carrying out the idle rotation while discharging and charging the electrophotographic photosensitive member similarly to the negatively charging system. It is efficient to apply the oxidation treatment after separating a development unit, a cleaning unit, and the like in contact with the electrophotographic photosensitive member from the electrophotographic photosensitive member to complete the oxidation treatment in a further short time.

[Electrophotographic Photosensitive Member Employable for Present Exemplary Embodiment]

In the following description, the electrophotographic photosensitive member suitable for the present exemplary embodiment will be described.

Figure 4:
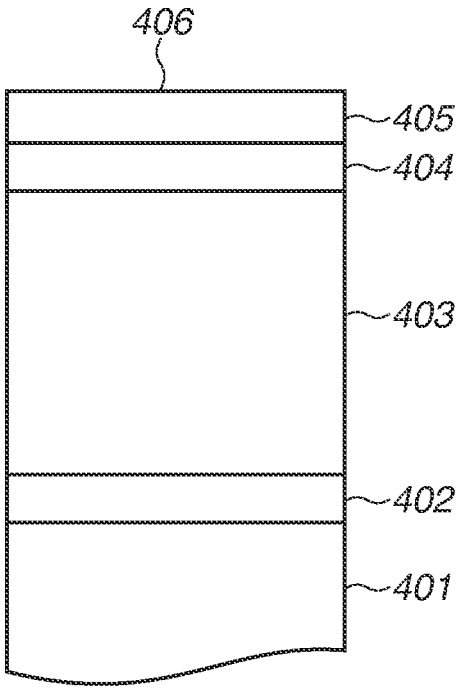
FIG. 4 schematically illustrates a layer structure of the electrophotographic photosensitive member suitable for the electrophotographic method according to an exemplary embodiment of the present disclosure.

FIG. 4 illustrates an example of a layer structure of the electrophotographic photosensitive member suitable for the present exemplary embodiment, and a lower blocking layer 402, a photoconductive layer 403, an intermediate layer 404, and a surface layer 405 are stacked on a conductive support substrate 401, and the surface layer 405 is made of hydrogenated amorphous carbon.

Next, each of the layers and the substrate forming the electrophotographic photosensitive member having the above-described layer structure will be described.

(Surface Layer)

Desirably, the above-described electrophotographic photosensitive member is an electrophotographic photosensitive member in which the surface layer thereof is made of hydrogenated amorphous carbon or hydrogenated amorphous silicon carbide.

Further, desirably, an average value of a ratio of the number of carbon atoms (C) to a sum of the number of carbon atoms (C) and the number of silicon atoms (Si) (C/(C+Si)) of the surface layer is 0.90 or higher. It is considered that achieving the ratio of 0.90 or higher can limit the oxidation to a degree that does not cause occurrence of image deletion under the high-humidity environment even when the surface layer is oxidized.

Further, desirably, an average value of a ratio of the number of hydrogen atoms (H) to a sum of the number of hydrogen atoms (H), the number of carbon atoms (C) and the number of silicon atoms (Si) (H/(H+C+Si)) of the surface layer is 0.40 or lower.

Achieving the ratio of 0.40 or lower can prevent negative ions from being transmitted through the surface layer when the negative ions are provided to the electrophotographic photosensitive member.

The material of the surface layer of the electrophotographic photosensitive member especially suitable for the present exemplary embodiment is hydrogenated amorphous carbon. This is because the negative ions can be further prevented from being transmitted through the surface layer when the negative ions are provided to the electrophotographic photosensitive member, by achieving 0.40 or lower as a hydrogen content ratio of hydrogenated amorphous carbon forming the surface layer (the number of hydrogen atoms to a sum of the number of carbon atoms and the number of hydrogen atoms).

It is considered that a reason therefor is that the reduction in the hydrogen content amount on the surface layer leads to an increase in bonds between the carbon atoms serving as framework atoms and an increase in the density of the framework atoms, thereby enhancing a barrier capability against the negative ions.

In a case where amorphous carbon including hydrogen is formed by using the plasma chemical vapor deposition (CVD) method, the hydrogen content ratio can be adjusted based on deposition condition parameters. Examples of the deposition condition parameters include a type of material gas, a flow rate of the material gas, high-frequency electric power, a reaction pressure, and a substrate temperature. As a result of an analysis, it has been confirmed that respective desirable directions as a direction for reducing the hydrogen content ratio are a direction for reducing the flow rate of the material gas, a direction for increasing the high-frequency electric power, a direction for reducing the reaction pressure, and a direction for increasing the substrate temperature. It has been revealed that, although any of the deposition parameters is effective from the viewpoint of the barrier capability, the high-frequency electric power and the substrate temperature are also deposition parameters that easily lead to a reduction in light transmittance of the surface layer. Therefore, it is useful to adjust the flow rate of the material gas and the reaction pressure under conditions of relatively low high-frequency electric power and a relatively low substrate temperature.

On the other hand, the reduction in the hydrogen content ratio of the surface layer causes the increase in the bonds between the carbon atoms, thereby easily leading to an increase in the $sp^2$ bond ratio. As the $sp^2$ bond ratio increases, the surface layer exhibits a characteristic closer to graphite, thereby easily reducing in electric resistance thereof. A factor affecting the image resolving power is surface resistance in the outermost surface region of the surface layer. This means that excellent image resolving power can be acquired by reducing the $sp^2$ bond ratio to 0.50 or lower in the outermost surface region of the surface layer.

Examples of a method for controlling the $sp^2$ bond ratio in the outermost surface region of the surface layer include a method that modifies the property of the outermost surface region. One specific method is to apply a plasma treatment using treatment gas containing oxygen atoms to disassociate a $\pi$ bond in the $sp^2$ bond in the outermost surface region and cause the oxygen atoms contained in the treatment gas containing the oxygen atoms to form an ether bond and ketone, by which the $sp^2$ bond ratio is considered to reduce as a result thereof. Examples of the treatment gas containing the oxygen atoms include oxygen ($O_2$), ozone ($O_3$), water vapor ($H_2O$), carbon monoxide (CO), carbon dioxide ($CO_2$), and nitric oxide (NO).

Further, a negative corona discharge treatment in the atmosphere is an effective method as the plasma treatment under the atmosphere. Regarding the negative corona discharge treatment in the atmosphere, highly oxidative negative ions such as nitrate ions generated from the negative corona discharge exert a function of disassociating the a bond in the $sp^2$ bond in the outermost surface region. It is considered that oxygen atoms contained in these negative ions form the ether bond and ketone, as a result of which the $sp^2$ bond ratio reduces and the surface resistance can be kept high.

(Intermediate Layer)

The intermediate layer is not limited in the electrophotographic photosensitive member suitable for the present exemplary embodiment, but the material thereof should be selected in consideration of an intermediary connection between the surface layer and the photoconductive layer. For example, in the case where the surface layer is made of hydrogenated amorphous carbon and the photoconductive layer is made of hydrogenated amorphous silicon, hydrogenated amorphous silicon carbide can be desirably used as the material of the intermediate layer. Appropriately setting the composition of the a-SiC:H intermediate layer facilitates a movement of photocarriers generated in the photoconductive layer due to the exposure to the surface layer.

Further, the movement of the photocarriers can be improved by providing a plurality of layers in which a ratio of the number of carbon atoms (C) to a sum of the number of carbon atoms (C) and the number of silicon atoms (Si) forming the a-SiC:H intermediate layer (C/(Si+C)) is changed in a stepwise manner. Alternatively, the above-described movement of the photocarriers can be improved by continuously changing the ratio of the number of carbon atoms (C) to the sum of the number of carbon atoms (C) and the number of silicon atoms (Si) forming the a-SiC:H intermediate layer (C/(Si+C)). Further, reflection of light that is generated on an interface between the surface layer and the intermediate layer and an interface between the intermediate layer and the photoconductive layer can be controlled by forming the intermediate layer by a plurality of layers or continuously changing the composition thereof. Further, this structure can also prevent a change in a sensitivity characteristic due to a change in a reflection characteristic that is caused along with a reduction in a film thickness of the surface layer that occurs when the photosensitive member is in long-term use.

Further, in the case of the electrophotographic photosensitive member for negative charging, a charging characteristic can be improved by providing charge injection blocking power to the intermediate layer. It is effective to put atoms belonging to group 13 of the periodic table into the a-SiC intermediate layer to enhance the charge injection blocking power. Among the atoms belonging to group 13 of the periodic table, the boron atom, the aluminum atom, and the gallium atom are desirable.

(Photoconductive Layer)

The photoconductive layer of the electrophotographic photosensitive member employed for the present exemplary embodiment may be any layer as long as it has a photoconductive characteristic capable of satisfying the performance regarding the electrophotographic characteristic, but a hydrogenated amorphous silicon photoconductive layer is desirable in light of durability and stability.

Possible candidates for an atom for controlling conductivity include a so-called impurity in the semiconductor field. More specifically, usable atoms include an atom belonging to group 13 of the periodic table that provides positive (P-type) conductivity, or an atom belonging to group 15 of the periodic table that provides negative (N-type) conductivity. Among the atoms belonging to group 13 of the periodic table, the boron atom, the aluminum atom, and the gallium atom are desirable. Among the atoms belonging to group 15 of the periodic table, the phosphorus atom and the arsenic atom are desirable.

The photoconductive layer may be formed by a single layer, or may be formed by a plurality of layers (for example, a charge generation layer and a charge transport layer).

(Lower Blocking Layer)

Desirably, the electrophotographic photosensitive member employed for the present exemplary embodiment is provided with the lower blocking layer working to block injection of charges from the substrate side between the substrate and the photoconductive layer. The lower blocking layer is a layer that functions to block the injection of the charges from the substrate to the photoconductive layer when the surface of the electrophotographic photosensitive member is subjected to charging processing of a certain polarity. To provide such a function, while the lower blocking layer is constructed based on the material forming the photoconductive layer, an atom usable to control the conductivity is put therein by a relatively large amount compared to the photoconductive layer.

An atom belonging to group 13 of the periodic table or group 15 of the periodic table can be used according to the charging polarity as the atom put into the lower blocking layer to control the conductivity.

Further, adhesiveness of the lower blocking layer with the substrate can be improved by putting at least one kind of atom among the carbon atom, the nitrogen atom, and the oxygen atom into the lower blocking layer.

(Conductive Substrate)

The conductive substrate is not especially limited and may be any substrate as long as it can hold the photoconductive layer and the surface layer formed on a surface thereof. Examples of the material of the substrate include metal such as aluminum and iron, and an alloy of them.

[Manufacturing Apparatus and Manufacturing Method for Manufacturing Electrophotographic Photosensitive Member Suitable for Present Exemplary Embodiment]

A manufacturing apparatus and a manufacturing method using the plasma CVD method will be described as an apparatus and a method for manufacturing the electrophotographic photosensitive member suitable for the present exemplary embodiment.

Figure 3:
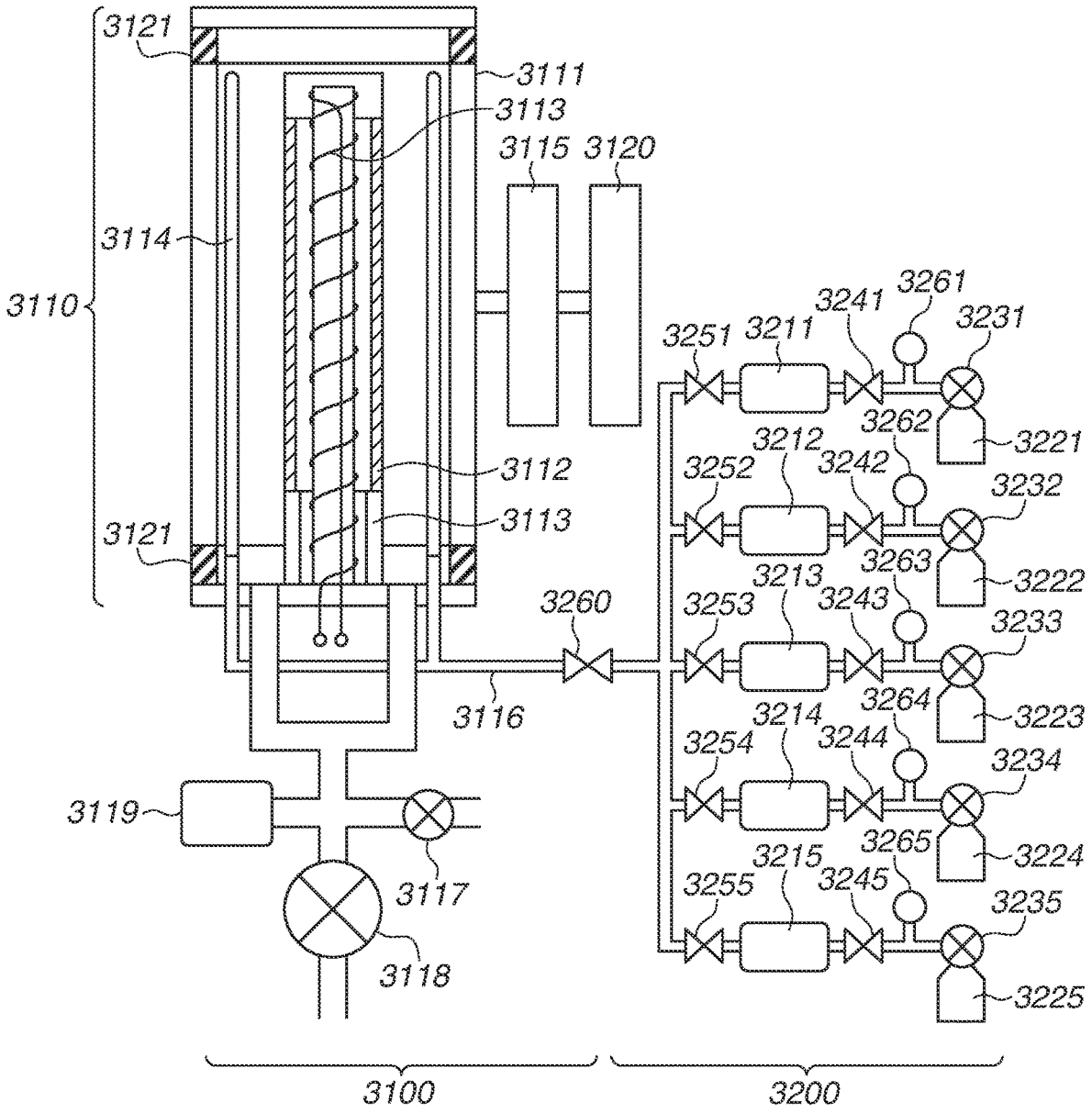
FIG. 3 schematically illustrates an apparatus for manufacturing the electrophotographic photosensitive member suitable for an electrophotographic method according to an exemplary embodiment of the present disclosure.

FIG. 3 schematically illustrates an example of a deposition apparatus for the electrophotographic photosensitive member by the radio frequency (RF) plasma CVD method using a high-frequency electric power source for preparing the photosensitive member according to the present exemplary embodiment.

Mainly, this deposition apparatus includes a deposition device 3100 including a reaction container 3110, a material gas supply device 3200, and an exhaust device (not illustrated) for reducing a pressure in the reaction container 3110.

A substrate 3112 connected to the earth, a substrate heating heater 3113, and a material gas introduction tube 3114 are set up in the reaction container 3110 in the deposition device 3100. Further, a high-frequency electric power source 3120 is connected to a cathode electrode 3111 via a high-frequency matching box 3115.

The material gas supply device 3200 includes material gas canisters 3221 to 3225, valves 3231 to 3235, pressure adjusters 3261 to 3265, and inflow valves 3241 to 3245. Further, the material gas supply device 3200 includes outflow valves 3251 to 3255 and mass flow controllers 3211 to 3215. The gas canisters 3221 to 3225 sealingly containing respective types of material gas are connected to the material gas introduction tube 3114 in the reaction container 3110 via an auxiliary valve 3260. FIG. 3 further illustrates a gas tube 3116, a leak valve 3117, and an insulative material 3121.

Next, a method for forming a deposition film using this apparatus will be described. First, the substrate 3112 degreased and washed in advance is set in the reaction container 3110 via a holding table 3123. Next, the exhaust device (not illustrated) is driven and the reaction container 3110 is evacuated. When the pressure in the reaction container 3110 reduces to a predetermined pressure such as 1 Pa or lower with a display of a vacuum meter 3119 under observation, electric power is supplied to the substrate heating heater 3113 and the substrate 3112 is heated to a predetermined temperature of 50 to 350° C. At this time, the substrate 3122 can also be heated under an inert gas atmosphere by supplying inert gas such as argon (Ar) and helium (He) from the gas supply device 3200 into the reaction container 3110.

Next, gas used to form the deposition film is supplied from the gas supply device 3200 into the reaction container 3110. More specifically, flow rates are set to the mass flow controllers 3211 to 3215 by opening the valves 3231 to 3235, the inflow valves 3241 to 3245, and the outflow valves 3251 to 3255 as necessary. When the flow rate of each of the mass flow controllers 3211 to 3215 is stabilized, the pressure in the reaction container 3110 is adjusted so as to become a desired pressure by operating a main valve 3118 with the display of the vacuum meter 3119 under observation.

When the desired pressure is achieved, a plasma discharge is induced in the reaction container 3110 by operating the high-frequency matching box 3115 at the same time as applying high-frequency electric power from the high-frequency electric power source 3120. After that, the high-frequency electric power is quickly adjusted to desired electric power and the deposition film is formed.

When the formation of the predetermined deposition film is completed, the application of the high-frequency electric power is stopped and the supply of the material gas is ended by closing the valves 3231 to 3235, the inflow valves 3241 to 3245, the outflow valves 3251 to 3255, and the auxiliary valve 3260. At the same time, the reaction container 3110 is evacuated until the pressure therein reduces to a pressure of 1 Pa or lower by fully opening the main valve 3118.

The formation of the deposition film is ended in this manner. In a case where a plurality of deposition films is formed, such formation can be achieved by repeating the above-described procedure again to form each of the layers. A joint region can also be formed by changing the flow rate of the material gas, the pressure, and the like to the conditions for forming the photoconductive layer in a predetermined time.

After the completion of the formation of all the deposition films, the substrate 3112 is extracted after the inside of the reaction container 3110 is returned to the atmospheric pressure by closing the main valve 3118 and introducing the inert gas into the reaction container 3110.

The following gas can be used as the material gas for supplying the carbon atoms to form the surface layer made of hydrogenated amorphous carbon. Desirably usable examples include methane ($CH_4$), ethane ($C_2H_6$), propane ($C_3H_8$), butane ($C_4H_{10}$), ethylene ($C_2H_4$), and acethylene ($C_2H_2$).

The control parameters such as the flow rate of the material gas, the reaction pressure, the high-frequency electric power, the substrate temperature, and a flow rate of diluent gas should be optimized to adjust the hydrogen content ratio of hydrogenated amorphous carbon. The hydrogen content ratio tends to reduce according to a reduction in the flow rate of the material gas. The hydrogen content ratio tends to reduce according to setting the reaction pressure to a low pressure. The hydrogen content ratio tends to reduce according to setting the high-frequency electric power to high electric power. The hydrogen content ratio tends to reduce according to setting the substrate temperature to a high temperature. Hydrogen ($H_2$) and helium (He) are useful as the dilute gas, and the hydrogen content ratio tends to reduce according to an increase in the flow rate of the dilute gas.

The outermost surface region of the surface layer made of hydrogenated amorphous carbon can be processed as intended by applying the plasma treatment thereon using gas containing oxygen atoms.

For example, silanes such as silane ($SiH_4$) and disilane ($Si_2H_6$) can be desirably used as the material gas for supplying silicon atoms to form the intermediate layer made of hydrogenated amorphous silicon carbide. Then, the intermediate layer is formed by setting the conditions such as the flow rate of the material gas to be supplied into the reaction container 3110, the high-frequency electric power, the pressure in the reaction container 3110, and the temperature of the substrate 3112 as necessary. The charge injection blocking power can be provided to the intermediate layer by forming the intermediate layer while adding the material gas containing the atom belonging to group 13 or group 15 of the periodic table according to the charging polarity. Examples of the material gas containing the atom belonging to group 13 or group 15 of the periodic table include phosphine ($PH_3$) and diborane ($B_2H_6$).

For example, silanes such as silane ($SiH_4$) and disilane ($Si_2H_6$) can be desirably used as the material gas for supplying silicon atoms to form the photoconductive layer made of hydrogenated amorphous silicon. For example, hydrogen ($H_2$) can also be desirably used in addition to the above-described silanes as the material gas for supplying hydrogen atoms.

Further, in the case where the above-described halogen atom, atom for controlling the conductivity, carbon atom, oxygen atom, nitrogen atom, and the like are put into the photoconductive layer, this can be realized by using a gaseous substance or a substance easily transformable into gas that contains each of the atoms as a material as appropriate.

Example 1 and Comparative Example 1

In the present example, the electrophotographic method according to the present exemplary embodiment was applied to an apparatus converted from a digital electrophotographic apparatus "imagePRESS C65" (trade name) manufactured by Canon, Incorporated.

As converted points, the electrophotographic photosensitive member including the surface layer made of hydrogenated amorphous carbon was mounted on a black (Bk) station of the digital electrophotographic apparatus "imagePRESS C65", and a charging setting, a exposure setting, and a development bias setting were optimized. The electrophotographic apparatus was configured in such a manner that the patches for evaluating the resolving power were able to be written onto the electrophotographic photosensitive member mounted on the Bk station, and were equipped with a density measurement instrument capable of measuring the density of the toner image developed by the development device on the electrophotographic photosensitive member. The electrophotographic apparatus was equipped with a determination unit configured to store the reference value defined based on the relationship between the area coverage modulation data of the patch and the measured density data and determine the resolving power from the measured density data. In the present example, the resolving power was evaluated using the patch patterns illustrated in FIG. 2A. Since the patch patterns illustrated in FIG. 2A are patch patterns corresponding to the same area coverage modulation and the different rulings, the determination about the resolving power is defined based on the density difference among the individual patches, and the resolving power of the electrophotographic photosensitive member can be determined to be higher as the density difference among the individual patches reduces.

In the present example, because the electrophotographic apparatus was a system using the electrophotographic photosensitive member including the surface layer made of hydrogenated amorphous carbon and configured to negatively charge the electrophotographic photosensitive member, the oxidation treatment was applied as the surface treatment of the electrophotographic photosensitive member. More specifically, the idle rotation was carried out by repeatedly charging and discharging the electrophotographic photosensitive member. A table 1 indicates electrophotographic photosensitive members used in the present example and the present comparative example, and the conditions.

In the following description, the electrophotographic photosensitive member used in the present example will be described.

(Electrophotographic Photosensitive Member)

Two electrophotographic photosensitive members were constructed under the conditions indicated in the table 1 using the above-described RF plasma CVD method, and the two electrophotographic photosensitive members were prepared by applying two types of surface treatments under conditions indicated in a table 2.

TABLE 1

| Gas Type and Flow Rate | Lower Prevention Layer | Photo-conductive Layer | Intermediate Layer | Surface Layer |
|---|---|---|---|---|
| $SiH_4$ [ml/min. (normal)] | 300 | 300 | 150 | |
| $H_2$ [ml/min. (normal)] | 480 | 680 | | |
| $B_2H_6$ [ppm] (with respect to $SiH_4$) | | | 150 | |
| NO [ml/min. (normal)] | 5 | | | |
| $CH_4$ [ml/min. (normal)] | 100 | | 200 | 50 |
| Reaction Pressure [Pa] | 40 | 80 | 53 | 50 |
| High-frequency Electric Power [W] | 200 | 600 | 400 | 400 |
| Substrate Temperature [° C.] | 270 | 260 | 240 | 240 |
| Film Thickness [μm] | 2.5 | 35 | 0.2 | 0.1 |

TABLE 2

| | Surface Treatment Conditions | |
|---|---|---|
| Gas Type and Flow Rate | S1 | S2 |
| $O_2$ [ml/min. (normal)] | 300 | 300 |
| $H_2$ [ml/min. (normal)] | 0 | 0 |
| Reaction Pressure [Pa] | 100 | 100 |
| High-frequency Electric Power [W] | 300 | 300 |
| Substrate Temperature [° C.] | 25 | 25 |
| Treatment Time [sec.] | 300 | 15 |

Output images were evaluated for the evaluation of the resolving power and the effect of the present exemplary embodiment was confirmed by the following specific method.

(Evaluation of Resolution Based on Output Image)

The image resolving power was evaluated by using the apparatus converted from the digital electrophotographic apparatus "imagePRESS C65" (trade name) manufactured by Canon, Incorporated. The converted apparatus was configured to allow primary charging and a development bias to be applied from an external electric power source. The resolution of the output image was evaluated based on an area coverage modulation image by using a halftone dot screen having the highest screen ruling of 230 lpi mounted on the main body.

Tone data evenly divided into 17 stages was used as the area coverage modulation image. At this time, a number was assigned to each of the tones with 16 assigned to the darkest tone and 0 assigned to the lightest tone, and was defined to indicate a tone stage.

With respect to each of the acquired images, the image density was measured by using a reflection densitometer (504 Spectro-densitometer manufactured by X-Rite, Incorporated) for each of 0 to 8 tones. In the measurement of the reflection density, three images were output for each of the tones and an average value of densities thereof was set as an evaluation value.

A value of a determination coefficient R2 at the time of linear approximation of the thus-acquired evaluation value and the tone stage was calculated, and a result thereof was evaluated with 0.996 or higher as A, 0.990 or higher and lower than 0.996 as B, and a value lower than 0.990 as C. The result evaluated as B or higher was determined to be able to acquire the effect of the present exemplary embodiment.

TABLE 3

| | Example 1 | | Comparative |
|---|---|---|---|
| | 1-1 | 1-2 | Example 1 |
| Surface Treatment Conditions When Electrophotographic Photosensitive Member was Prepared | S1 | S2 | S2 |
| Evaluation of Resolving Power in Electrophotographic Apparatus | Conducted | Conducted | Not Conducted |
| Determination about Whether Surface Treatment is Necessary | Unnecessary | Necessary | — |
| Surface Treatment in Electrophotographic Apparatus | Not Applied | Applied | Not Applied |
| Result of Evaluation of Resolution based on Output Image | A | A | C |

In an example 2, two types of electrophotographic photosensitive members were prepared similarly to the example 1. A table 4 indicates the electrophotographic photosensitive members used in the present example, and the conditions. The same conditions as the example 1 were employed as the evaluation method and criteria. The present example was different in terms of use of the patch patterns illustrated in FIG. 2B as the image patterns of the test images for determining the resolving power of the electrophotographic photosensitive member.

TABLE 4

| | Example 2 | |
|---|---|---|
| | 2-1 | 2-2 |
| Surface Treatment Conditions When Electrophotographic Photosensitive Member was Prepared | S1 | S2 |
| Evaluation of Resolving Power in Electrophotographic Apparatus | Conducted | Conducted |
| Determination about Whether Surface Treatment is Necessary | Unnecessary | Necessary |
| Surface Treatment in Electrophotographic Apparatus | Not Applied | Applied |
| Result of Evaluation of Resolution based on Output Image | A | A |

In the above-described manner, according to the present disclosure, the resolving power of the electrophotographic photosensitive member can be accurately detected during the non-image formation period, and the resolving power of the electrophotographic photosensitive member can be recovered by applying the surface treatment on the electrophotographic photosensitive member as necessary. As a result, the original performance of the electrophotographic apparatus can be maintained.

While the present innovation has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-036834, filed Feb. 28, 2019, which is hereby incorporated by reference herein in its entirety.

What is claimed is:

1. A method for controlling an electrophotographic apparatus, the electrophotographic apparatus including:

a charging unit configured to charge an electrophotographic photosensitive member, an exposure unit configured to form a latent image on the charged electrophotographic photosensitive member, a development unit configured to develop the latent image with toner to form a toner image, and a measurement unit configured to measure a density of the toner image, the method for controlling the electrophotographic apparatus comprising:

storing two types of test image data acquired by performing first halftone processing and second halftone processing on image data having a predetermined image density into a storage unit of the electrophotographic apparatus in advance, and, during a non-image formation period, forming two types of test images from the two types of test image data, measuring densities of the two types of test images, calculating a density difference between the two types of test images, determining whether the density difference is equal to or smaller than a predetermined reference value or exceeds the predetermined reference value, and applying a surface treatment on the electrophotographic photosensitive member if the density difference exceeds the predetermined reference value, wherein the density of the image data having the predetermined image density is lower than 50%.

2. The method for controlling the electrophotographic apparatus according to claim 1, wherein the first halftone processing and the second halftone processing are dither processing procedures corresponding to different resolutions.

3. The method for controlling the electrophotographic apparatus according to claim 2, wherein the first halftone processing is dither processing corresponding to a higher resolution than dither processing used during an image formation period.

4. The method for controlling the electrophotographic apparatus according to claim 1, wherein the first halftone processing is error diffusion processing, and the second halftone processing is dither processing.

5. The method for controlling the electrophotographic apparatus according to claim 1, wherein the surface treatment is a treatment for removing an attached substance on a surface of the electrophotographic photosensitive member, or a treatment for oxidizing the surface of the electrophotographic photosensitive member.

6. The method for controlling the electrophotographic apparatus according to claim 1, wherein a surface layer of the electrophotographic photosensitive member is made of hydrogenated amorphous carbon or hydrogenated amorphous silicon carbide.

7. The method for controlling the electrophotographic apparatus according to claim 1, wherein a surface layer of the electrophotographic photosensitive member is made of hydrogenated amorphous carbon or hydrogenated amorphous silicon carbide, wherein an average value of a ratio of the number of carbon atoms (C) to a sum of the number of carbon atoms (C) and the number of silicon atoms (Si) (C/(C+Si)) of the surface layer is 0.90 or higher, wherein an average value of a ratio of the number of hydrogen atoms (H) to a sum of the number of hydrogen atoms (H), the number of carbon atoms (C), and the number of silicon atoms (Si) (H/(H+C+Si)) of the surface layer is 0.40 or lower, and wherein the surface treatment of the electrophotographic photosensitive member is a treatment for oxidizing an outermost surface of the electrophotographic photosensitive member by providing a negative charge to a surface of the electrophotographic photosensitive member.

8. A method for controlling an electrophotographic apparatus, the electrophotographic apparatus including:

a charging unit configured to charge an electrophotographic photosensitive member, an exposure unit configured to form a latent image on the charged electrophotographic photosensitive member, a development unit configured to develop the latent image with toner to form a toner image, and a measurement unit configured to measure a density of the toner image, the method for controlling the electrophotographic apparatus comprising:

forming two types of test images by performing first halftone processing and second halftone processing on image data having a predetermined image density, measuring densities of the two types of test images, calculating a density difference between the two types of test images, determining whether the density difference is equal to or smaller than a predetermined reference value or exceeds the predetermined reference value, and applying a surface treatment on the electrophotographic photosensitive member if the density difference exceeds the predetermined reference value, during a non-image formation period; wherein the density of the image data having the predetermined image density is lower than 50%.

9. A method for controlling an electrophotographic apparatus, the electrophotographic apparatus including:

a charging unit configured to charge an electrophotographic photosensitive member, an exposure unit configured to form a latent image on the charged electrophotographic photosensitive member, a development unit configured to develop the latent image with toner to form a toner image, and a measurement unit configured to measure a density of the toner image, the method for controlling the electrophotographic apparatus comprising:

forming a plurality of test images by performing predetermined halftone processing on pieces of image data having a plurality of image densities, measuring densities of the plurality of test images, calculating linearity between the image data having the image density and the density, determining whether the linearity is lower than a predetermined reference value or equal to or higher than the predetermined reference value, and applying a surface treatment on the electrophotographic photosensitive member if the linearity is lower than the predetermined reference value during a non-image formation period, wherein the densities of the pieces of image data having the plurality of image densities are lower than 50%.

10. The method for controlling the electrophotographic apparatus according to claim 9, wherein the predetermined halftone processing is dither processing corresponding to a higher resolution than dither processing used during an image formation period.

11. The method for controlling the electrophotographic apparatus according to claim 9, wherein the predetermined halftone processing is error diffusion processing.

* * * * *